US006174389B1

(12) United States Patent
Mann

(10) Patent No.: US 6,174,389 B1
(45) Date of Patent: Jan. 16, 2001

(54) FIXTURE AND METHOD FOR SELECTIVELY QUENCHING A PREDETERMINED AREA OF A WORKPIECE

(75) Inventor: Kenneth R. Mann, Metamora, IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/375,628

(22) Filed: Aug. 17, 1999

(51) Int. Cl.[7] ..... C21D 1/62; C21D 6/00

(52) U.S. Cl. ..... 148/644; 148/641; 148/640; 266/134

(58) Field of Search ..... 148/627, 637, 148/638, 639, 641, 644; 266/134

(56) References Cited

U.S. PATENT DOCUMENTS

| | | | |
|---|---|---|---|
| 125,650 | 4/1872 | Woodbury . | |
| 1,828,325 | 10/1931 | Kurz . | |
| 2,263,621 | 11/1941 | Frickey | 266/6 |
| 3,765,660 * | 10/1973 | Taylor et al. | 148/644 |
| 4,486,248 | 12/1984 | Ackert et al. | 148/145 |
| 4,810,311 | 3/1989 | Economopoulos | 148/128 |
| 5,000,798 | 3/1991 | Nott et al. | 148/146 |
| 5,390,900 * | 2/1995 | Ginzburg | 148/644 |
| 5,553,106 * | 9/1996 | Enomoto et al. | 148/644 |

* cited by examiner

*Primary Examiner*—Deborah Yee
(74) *Attorney, Agent, or Firm*—Robert A. McFall

(57) ABSTRACT

An apparatus and method for excluding specific areas of a workpiece from quenching during a heat treat process. A workpiece, having preselected areas to be quenched, is positioned in a manner so that quench sprays are aimed toward the surface to be quenched. The area to be excluded from the quench is protected by a shroud, and steam is forced under the shroud during the quenching operation. Steam pressure within the shroud is maintained at a pressure sufficient to prevent the quench media from passing through a sealed edge of the shroud. The steam has a temperature sufficient to prevent a sudden drop in the workpiece temperature in the area protected from the quench media.

9 Claims, 1 Drawing Sheet

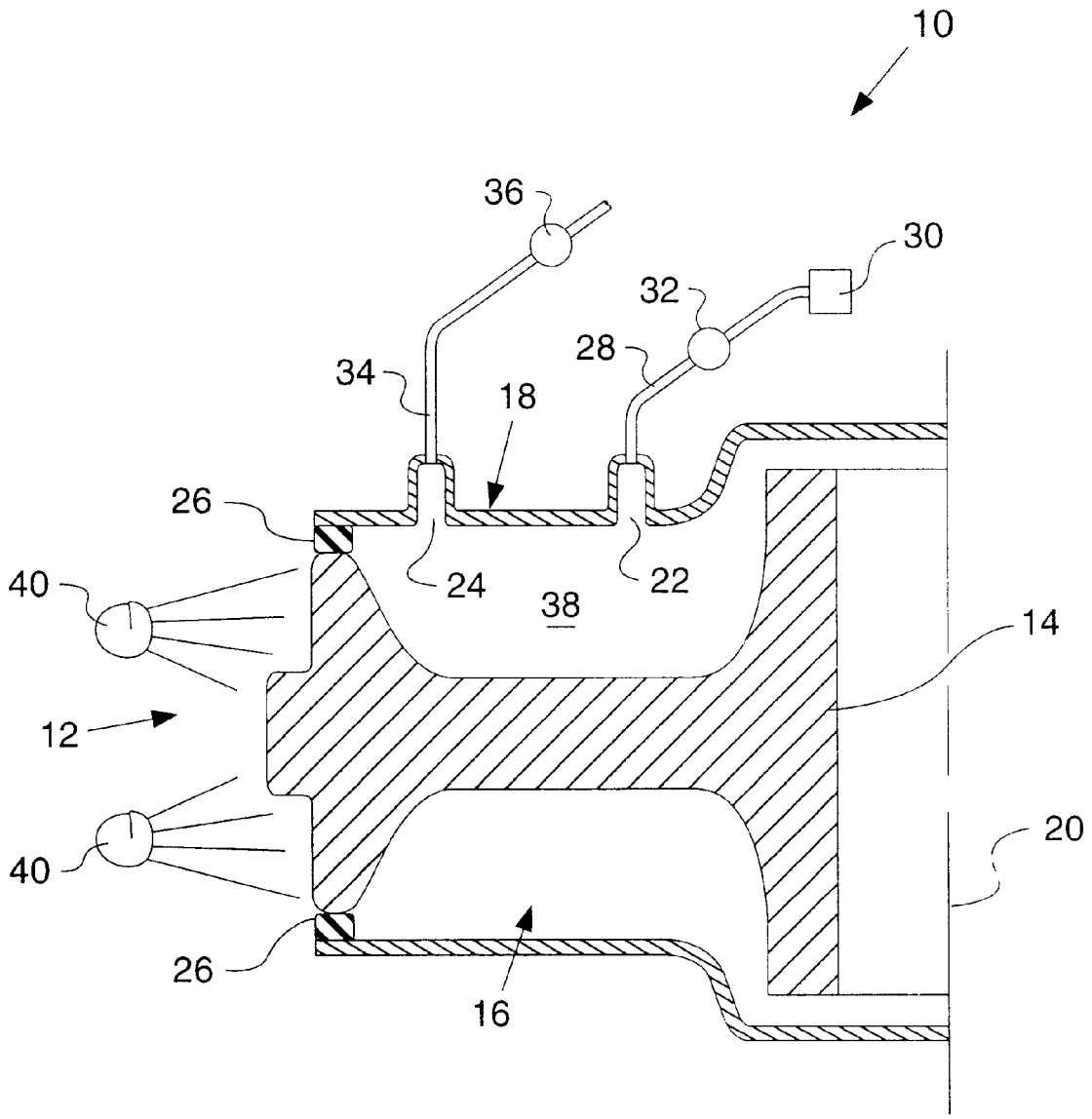
10
36
30
32
28
34
18
26
24
22
38
40
14
12
20
40
26
16

FIXTURE AND METHOD FOR SELECTIVELY QUENCHING A PREDETERMINED AREA OF A WORKPIECE

TECHNICAL FIELD

This invention is generally directed to a fixture and method for maintaining a preselected area of a workpiece at a temperature above that of a quenched area during quenching, and more particularly to a fixture for quenching a first predetermined area of a workpiece and maintaining a second predetermined area of the workpiece at a temperature above the first predetermined area during quenching, and to a method for maintaining the second predetermined area of the workpiece at a temperature above that of the first predetermined area during quenching.

BACKGROUND ART

Heat treated articles, for example articles that are formed of metal alloys such as steel, are typically quenched from elevated temperatures by coolants, such as water, water-based liquids, oil, or other liquid media, to effect metallurgical hardening. Often certain areas of the workpiece need to be protected from the coolant to preserve low hardness and high ductility in those areas. A quench fixture is often employed to direct the coolant to some areas and partially exclude it from other areas.

Examples of cooling selected areas of a workpiece are described in U.S. Pat. No. 5,000,798 issued Mar. 19, 1991 to Murray A. Nott, et al and titled *Method for Shape Control of Rail During Accelerated Cooling*. In the Nott apparatus, coolant is sprayed onto selected areas of the workpiece to control the shape or straightness of the article. Much earlier, U.S. Pat. No. 1,828,325 was issued to Heinrich Kurz on Oct. 20, 1931, for *Process for the Manufacture of Rails with Hardened Heads*. The Kurz patent describes a quench fixture, and method of using the fixture, in which different coolants are directed to separate preselected areas of the workpiece to develop different metallurgical properties in different portions of the workpiece. For example, air or steam is directly against the upper side of the web of a rail while a liquid coolant is directed to the head of the rail.

In an attempt to prevent the quench media from effecting areas of the workpiece that are not to be hardened, shrouds intended to contain the quench media have been used, but with only limited success. For example, U.S. Pat. No. 4,486,248 issued to Robert J. Ackert, et al on Dec. 4, 1984 for *Method for the Production of Improved Railway Rails by Accelerated Cooling In Line with the Production Rolling Mill* describes quench media spray heads disposed within a shroud structure. As mentioned above, such shrouds have been only partially successful in preventing the quench media from effecting areas of the workpiece in which hardening is not desired. Leaks of the coolant past the shroud results in quenching and transformation hardening in areas intended to remain soft, and can cause breakage of the workpiece during future service. Attempts to pressurize the unquenched areas with air can result in localized cooling and unintended hardening. Vacuum devices to siphon coolant flows are not always effective.

The present invention is directed to overcoming the problems set forth above. It is desirable to have a heat treat fixture and a method of heat treating in which areas of the workpiece that are not to be cooled by the quench media are protected by pressurized steam which disburses any quench coolant that may inadvertently pass through a barrier between the quenched and unquenched areas of the workpiece. It is also desirable to have such a fixture and method where the steam pressure is maintained at a value sufficient to exclude quench coolant from contacting preselected nonquenched areas of the workpiece. Furthermore, it is desirable to have a pressurized steam chamber wherein the steam temperature can be held at a temperature sufficient to maintain the preselected nonquenched areas at or above the transition temperature, i.e., the Martensite start temperature ($M_s$ in the case of steel), to allow slow cooling of the nonquenched areas after quenching the workpiece.

DISCLOSURE OF THE INVENTION

In accordance with one aspect of the present invention, a heat treating fixture for quenching a first predetermined area of a workpiece and maintaining a second predetermined area of the workpiece at a temperature above the first predetermined area during quenching, includes a shroud extending over the second predetermined area and having an inlet port, a vent port, and a seal member positionable between the shroud and the workpiece at a boundary between the first and second predetermined areas. The fixture also includes a supply conduit in fluid communication with the inlet port of the shroud and with a source of steam, and an exhaust conduit in fluid communication with the vent port of the shroud.

Other features of the heat treating fixture embodying the present invention include a throttle valve disposed in the supply conduit at a position between the inlet port and the source of steam. Yet another feature includes the exhaust conduit having a pressure regulator valve disposed therein. Still another feature includes the seal member disposed between the shroud and the workpiece being formed of a heat-resistant material such as steel.

In another aspect of the present invention, a method for maintaining a second predetermined area of a workpiece at a temperature above that of a first predetermined area during quenching includes positioning a shroud, having at least one sealing edge, over the second predetermined area of the workpiece, thereby forming a sealed chamber that is defined by the second predetermined area of the workpiece and the shroud. A pressurized flow of steam is directed into the sealed chamber, and the first predetermined area of the workpiece is quenched while simultaneously maintaining positive steam pressure within the sealed chamber. After quenching is completed, the quenching is stopped and the flow of steam into the sealed chamber is interrupted prior to removing the shroud from the workpiece.

Other features of the method embodying the present invention includes controllably regulating the flow of steam introduced into the chamber. Yet another feature includes controllably regulating the flow of the steam vented from the sealed chamber. Still another feature includes maintaining the steam pressure in the sealed chamber at a pressure of about 70 $kN/m^2$ (10 psi).

Another feature of the present invention includes the workpiece having a steel composition, and the steam directed into the sealed chamber having a temperature sufficient to maintain the second predetermined area of the workpiece at a temperature above the transformation temperature of the steel composition of the workpiece, for a period of time sufficient to provide cooling of the second predetermined area at a rate less than that of the first predetermined area of the workpiece.

BRIEF DESCRIPTION OF THE DRAWING

A more complete understanding of the fixture and method of the present invention may be had by reference to the following detailed description when taken into conjunction with the accompanying single drawing FIGURE which is a schematic representation of the heat treating fixture embodying the present invention.

BEST MODE FOR CARRYING OUT THE INVENTION

As shown in the sole drawing figure, a heat treating fixture 10 for quenching a first predetermined area 12 of a workpiece 14, and maintaining a second predetermined area 16 of the workpiece 14 at a temperature above that of the first predetermined area 12 during quenching, includes a protective shroud 18 encompassing the second predetermined area 16. In an illustrative embodiment, as represented schematically in the drawing figure, the workpiece 14 comprises an idler wheel or alternatively, a sprocket wheel suitable for use on an earth moving vehicle. In such applications, it is equally desirable that the external diameter of the wheel be quenched to provide a hardened wear surface, whereas it is desirable to maintain the web and hub sections of the wheel at a lower hardness and greater ductility.

The shroud 18 may, for ease of assembly of the workpiece 14 within the shroud 18, comprise separable upper and lower portions. However, for the sake of the following discussion, the shroud 18 will be treated as a unitary structure. In other applications, the shroud 18 may have different shapes which are compatible with protecting the desired unquenched areas of the workpiece 14, and may comprise either single, double or multiple components. Desirably, the shroud 18 is formed of a corrosion-resistant metallic material such as stainless steel. In the illustrated embodiment, the fixture 10 and workpiece 14 are symmetric about a center line 20 of the workpiece 14 and shroud 18. To simplify the following description of the fixture, only the left half of the symmetric fixture 10 and workpiece 14 are illustrated.

The fixture 10 has, a seal member 26 adapted to be positioned between the shroud 18 and the workpiece 14 at the desired boundary between the first predetermined area 12 to be quenched, and the second predetermined area 16 to be protected from the quench media. The seal member 26 may be formed of a suitable material, such as steel, and may be segmented or heat-resistant of a single piece design, alternatively, the seal member may be spring-biased, hydraulically or pneumatically actuated sliding dead weight, or close-fit designs. Due to the subsequent steam pressurization of the area defined by the second predetermined area 16 of the workpiece 14 and the shroud 18, the seal 26 does not have to be air tight. However the seal member 26 should generally conform to the boundary area of the workpiece 14 so that the amount of steam passing through any clearances around the seal member 26 and the workpiece 14 is minimized.

The shroud 18 also includes an inlet port 22 and a vent port 24. A supply conduit 28 is arranged to provide fluid communication with the inlet port 22 of the shroud 18 and a source of steam 30. The steam source may be provided by a single plant source or by a separate steam generator dedicated to this specific application. Desirably, a variable throttle value 32 is disposed in the supply conduit 28 at a position between the inlet port 22 and the source of steam 30, to controllably regulate the flow of steam into a sealed chamber 38 that is defined by the second predetermined area 16 of the workpiece 12 the seal member 26 and the shroud 18.

The fixture 10 further includes an exhaust conduit 34 in fluid communication with the vent port 24 and the environment external of the shroud 18. Desirably, a pressure regulator value 36 is disposed in the exhaust conduit 34 at a position between the vent port 24 and the external environment for the purpose of regulating the steam pressure within the sealed chamber 38.

A method, in accordance with the present invention, for maintaining the second predetermined area 16 of the workpiece 14 at a temperature above that of the first predetermined area 12 of the workpiece 14 during quenching includes positioning the shroud 18 over the second predetermined area 16 of the workpiece 14 thereby forming, in cooperation with the seal member 26, a sealed chamber 38 defined by the second predetermined area 16 of the workpiece 14 and the shroud 18. A pressurized flow of steam from the source 30 is then directed, by way of the supply conduit 28 and the inlet port 22, into the sealed chamber 38. The flow of steam into and out of the chamber 38, and accordingly the steam pressure within the chamber 38, is controllably regulated by adjusting the throttle valve 32 and/or the pressure regulator valve 36 to maintain a desired positive steam pressure, for example, a pressure of at least about 70 $kN/m^2$ (10 psi) in the sealed chamber 38.

The first predetermined area 12 of the workpiece 14 is then quenched by spraying water or other quench media from prepositioned nozzles 40 directly onto the desired area to be quenched. Entry of the sprayed quench media into the sealed chamber 38, and consequently in contact with portions of the second predetermined area 16 where quenching is not desired, is at least partially precluded by the shroud 18. The high energy content of the steam within the sealed chamber 38 rapidly quenches any coolant which may unintentionally leak through the seal member 26. Furthermore, the positive steam pressure maintained within the shroud 18 during quenching additionally acts to exclude quench coolant from the sealed chamber 38. Also, and of significant importance, the steam temperature, which is readily controllable by any one of several known methods, holds the protected areas, i.e. the second predetermined area 16, at or above the transition temperature (the Martensite start temperature, $M_s$ in the case of steel) to allow slow cooling of the protected area during and after the quench.

After quenching is complete, the flow of quench media through the nozzles 40 is stopped, the flow of steam to the sealed chamber 38 is subsequently interrupted, and the shroud 18 is removed from its surrounding relationship over the second predetermined area 16 of the workpiece 14. The removal of the shroud 18 may be delayed, if so desired, to permit slow controlled cooling of the second predetermined area 16, either with or without a continued flow of steam after the quench. As noted above, the pressurized flow of steam into the sealed chamber 38 may be controlled by regulating the pressure regulator valve 36 in the exhaust conduit 34, by regulating the throttle valve 32 in the supply conduit 28, or by a combination of regulating both valves 32, 36.

INDUSTRIAL APPLICABILITY

The heat treating fixture 10 and method for selectively quenching a predetermined area 12 of a workpiece 14 using the fixture 10 provides significant benefits by protecting areas 16 of the workpiece 14 that would be disadvantageously affected if contacted by quench media during the quenching operation.

More specifically, the method and apparatus embodying the present invention excludes specific areas of a workpiece 14 from quenching during the heat treat process. A workpiece 14 to be quenched is positioned in a manner that quench sprays are aimed toward the surface to be quenched. The area to be excluded from the quench is protected by a shield, while steam is forced under the shield. The steam prevents a sudden temperature drop in the protected area of the workpiece 14 and pressurizes a cavity 38 formed over the protected area to prevent the quench media from passing the shield.

Although the present invention is described in terms of a preferred exemplary embodiment, with illustration of a specific shroud shape for an exemplary workpiece, those skilled in the art will recognize that changes in the shroud shape to protect selected areas of differently shaped workpieces may be made without departing from the spirit of the invention. Such changes are intended to fall within the scope of the following claims. Other aspects, features, and advantages of the present invention may be obtained from a study of this disclosure, along with the appended claims.

What is claimed is:

1. A heat treating fixture for quenching a first predetermined area of a workpiece and maintaining a second predetermined area of the workpiece at a temperature above the temperature of the first predetermined area during quenching, said fixture comprising:

a shroud extending over said second predetermined area and having an inlet port and a vent port;

a seal member adapted to be positioned between said shroud and said workpiece at a boundary between said first and said second preselected areas;

a supply conduit adapted to provide fluid communication between said inlet port of the shroud and a source of steam; and an exhaust conduit in fluid communication with the vent port of the shroud.

2. The heat treating fixture, as set forth in claim 1, wherein said supply conduit includes a throttle valve disposed therein at a position between said inlet port and said source of steam.

3. The heat treating fixture, as set forth in claim 1, wherein said exhaust conduit includes a pressure regulator valve.

4. The heat treating fixture, as set forth in claim 1, wherein said seal member is formed of steel.

5. A method for maintaining a second redetermined area of a workpiece at a temperature above the temperature of a first predetermined area of the workpiece during quenching, said method comprising:

positioning a shroud, having at least one sealing edge, over said second predetermined area of the workpiece, thereby forming a sealed chamber defined by the second predetermined area of the workpiece and the shroud;

directing a pressurized flow of steam into said sealed chamber;

quenching said first predetermined area of the workpiece while simultaneously maintaining a positive steam pressure in said sealed chamber;

stopping the quenching of the first predetermined area of the workpiece;

interrupting the flow of steam to the sealed chamber; and removing said shroud from the workpiece.

6. The method for maintaining a second predetermined area of a workpiece at a temperature above the temperature of a first predetermined area of the workpiece during quenching, as set forth in claim 5, wherein said directing a pressurized flow of steam to said sealed chamber includes controllably regulating the flow of steam introduced into the sealed chamber.

7. The method for maintaining a second predetermined area of a workpiece at a temperature above the temperature of a first predetermined area of the workpiece during quenching, as set forth in claim 5, wherein said directing a pressurized flow of steam to said sealed chamber includes controllably regulating the flow of steam vented from the sealed chamber.

8. The method for maintaining a second predetermined area of a workpiece at a temperature above the temperature of a first determined area of the workpiece during quenching, as set forth in claim 5, wherein said simultaneously maintaining a positive steam pressure in said sealed chamber includes maintaining said steam pressure at a pressure of about 70 $kN/m^2$ (10 psi).

9. The method for maintaining a second predetermined area of a workpiece at a temperature above the temperature of a first predetermined area of the workpiece during quenching, as set forth in claim 5, wherein said workpiece has a steel composition with a defined transformation temperature at which the formation of martensite is initiated, and said directing a pressurized flow of steam into said sealed chamber includes directing a pressurized flow of steam into the sealed chamber having a temperature sufficient to maintain the second predetermined area of the workpiece at a temperature above the transformation temperature of the steel composition of the workpiece for a period of time sufficient to provide cooling of the second predetermined area at a rate less than that of the first predetermined area of the workpiece.

* * * * *